United States Patent [19]

Doerschuk et al.

[11] 4,365,351

[45] Dec. 28, 1982

[54] DIVING SUIT WITH NECK AND WRIST SEALS

[75] Inventors: David C. Doerschuk, Grove City, Ohio; James F. Mank, Ottumwa, Iowa

[73] Assignee: The United States of America as represented by the Secretary of the Navy, Washington, D.C.

[21] Appl. No.: 252,725

[22] Filed: Apr. 10, 1981

[51] Int. Cl.[3] ..... B63C 11/04

[52] U.S. Cl. ..... 2/2.1 R

[58] Field of Search ..... 2/2.1 R, 6, 270, 2, 2/128, 135, 141 R, 91, 203, 170, 67, 68; 128/201.23, 201.24, 201.27, 202.11; 285/311; 405/186

[56] References Cited

U.S. PATENT DOCUMENTS

| | | | |
|---|---|---|---|
| 2,411,830 | 11/1946 | Krupp | 2/82 |
| 2,517,748 | 8/1950 | Williams | 2/82 |
| 2,888,011 | 10/1949 | Penrod et al. | 128/143 |
| 3,351,056 | 2/1965 | Durney | 128/142.5 |
| 3,353,534 | 10/1964 | Savoie, Jr. | 128/142.3 |
| 3,493,972 | 12/1967 | Oldham | 2/2.1 |
| 3,534,408 | 1/1968 | Fifield | 2/2.1 |
| 3,958,275 | 3/1975 | Morgan et al. | 2/2.1 R |
| 4,168,543 | 10/1979 | Baker | 2/91 |

*Primary Examiner*—Werner H. Schroeder
*Assistant Examiner*—Steven N. Meyers
*Attorney, Agent, or Firm*—Robert F. Beers; Harvey A. David

[57] ABSTRACT

A diving suit is provided with neck and wrist opening seals each in the form of a right cylindrical annulus of open celled resilient foam rubber having a through passage a portion of which is cylindrical and a portion of which is frustoconical so that part of the annulus wall is of uniform thickness and part is tapered. The tapered portion overlies a conical, opening defining edge portion of the suit fabric and a band of non-stretch tape fixes the tapered edge portion of the annulus to the fabric while allowing the thicker wall portion to expand and contract as a head or hand is pushed through. The outer cylindrical surface beyond the tape is adapted to cooperate with a mask hood or glove cuff.

12 Claims, 5 Drawing Figures

DIVING SUIT WITH NECK AND WRIST SEALS

BACKGROUND OF THE INVENTION

This invention relates generally to the field of diving suits, and more particularly to improvements in sealing the wrist and neck openings thereof against the intrusion of water.

Diving suits are available in a wide variety and include so called wet suits and dry suits. In the former the suits are generally made to be close fitting and of thermally insulating material so that any water between the suit and the wearer's body is only a thin layer. The wet suit, once flooded, does not exchange much water and so is fairly effective at retaining body heat when used in water of moderate temperatures.

Diving and working in extremely cold water, however, calls for more stringent measures in conservation of body heat than is generally afforded by wet suits. Accordingly, under those circumstances a relatively loosely fitting, substantially watertight, dry suit is preferred that accommodates the use of thermally protective insulating underwear, which may also incorporate electrical, hot water, or chemical heating means.

Some dry suits have gloves or mittens integrally formed on the sleeves, and are designed so that the upper portion of the suit is directly connected, as by suitable clamp means, to a diving helmet. While those suits are notably effective in remaining internally dry, except for moisture condensing from the breathing gas, perspiration moisture, and the like, they are not readily used with hooded diving helmets or masks of the type that are not clamped directly to the suit. The integral gloves or mittens have often been ill fitting and cumbersome. Moreover, a tear or cut in the glove, which is likely to happen in working situations, results in substantial flooding of the suit.

U.S. Pat. Nos. 2,888,011; 3,351,056; 3,353,534; 3,534,408; and 3,958,275 are examples of helmet seals between the helmet and the neck or between the helmet and the suit, but do not disclose any seal between the suit and the neck of the diver that will prevent water entry to a suit while using a non-suit connected helmet or hooded mask. U.S. Pat. No. 3,493,972 discloses a waterproof suit having a continuous elastic seal about the neck and "conventional" wrist seals. Conventional wrist seals on diving suits have generally constituted tubular, thin-walled elastic rubber cuffs that grip the wrist of the diver after he forces his hand through. Other wrist and neck seals have comprised an in-turned or reentrant elastic cuff in an effort to exclude water.

Neck and wrist seals that rely on tight elastic bands or cuffs tend to restrict the diver's circulation of blood, or if not so tight as to inhibit circulation are prone to leak, especially with active movements during work.

SUMMARY OF THE INVENTION

With the foregoing in mind, it is a principle object of this invention to provide improved sealing against the entry of water at the wrist and/or neck openings of a dry diving suit.

Another object is to provide diving suit wrist and/or neck seals that are effective in use, comfortable to wear, and easily donned and doffed.

Still another object is to provide such wrist and/or neck sealing devices that are readily added to or removed from the suit for replacement purposes.

Yet another object is to provide wrist and/or neck seals of the foregoing character that are economical to manufacture.

As another object, the invention aims to provide such seals that are compatible in use with hooded diving masks or helmets and with separable diving gloves.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
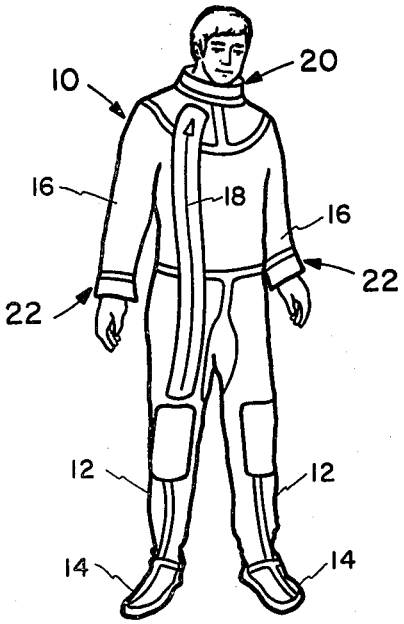
FIG. 1 is a front view of a diving suit embodying neck and wrist seals according to the invention.

Referring first to FIG. 1, a diver's suit embodying seals according to this invention is indicated generally at 10 and is formed as a somewhat loosely fitting body covering including leg portions 12, having integral boots or foot coverings 14, and sleeves 16. The suit is provided with a waterproof zipper 18 that permits the wearer to don the suit readily.

A neck seal 20, discussed more fully hereinafter, provides substantially water tight integrity between the wearer's neck and a neck opening of the suit which is just large enough to pass a wearer's head with ease. Wrist seals 22, also discussed more fully hereinafter, provide similar watertight integrity between the wearer's wrists and the end openings of the sleeves 16.

Figure 2:
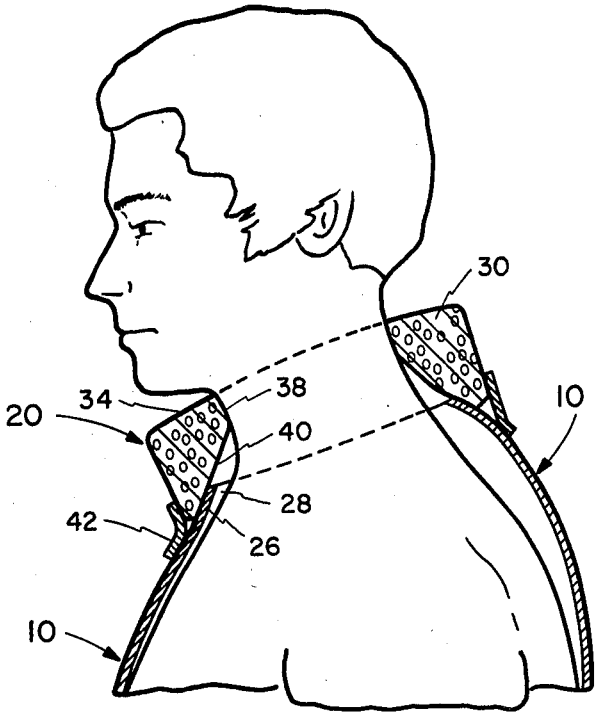
FIG. 2 is a fragmentary sectional view, on an enlarged scale, illustrating the neck portion of the diving suit with its neck seal in use.
Figure 3:
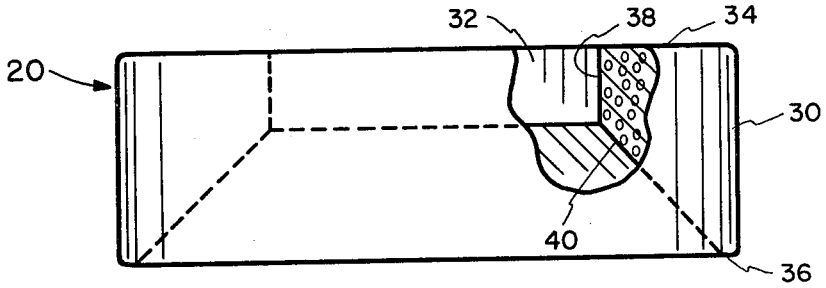
FIG. 3 is an elevational view of the neck seal of FIG. 2, shown separately.

Referring now to FIG. 2, the waterproof fabric of the suit 10 terminates in a conical, neck encircling edge portion 26 defining the neck opening 28. The seal 20 is formed of a resiliently yieldably sodium bicarbonate or other chemically blown neoprene rubber foam material. With reference now to FIG. 3, the seal 20 comprises a right cylindrical body 30 of that material having a central, axial passage 32 therethrough. The top surface 34 is annular and parallel to the annular bottom edge 36. The inner surfaces defining the passage 32 include a cylindrical surface 38 and a frustoconical surface 40, resulting in the passage 32 having a tapered entryway from the bottom. In an actual embodiment the seal 20 has an outer diameter of 8.1 inches, a length top to bottom of 2.75 inches, an inside diameter at the small end of passage 32 of 4.5 inches, and a cylindrical inner surface 38 of 1.0 inch in length. The frustoconical surface 40 is at an angle of about 45° to the axis so that the passage tapers inwardly substantially from the bottom edge 36. The foam rubber material is essentially open-celled. That is to say, the cells communicate with one another internally of the body 30. However, it is advantageously molded so as to have a substantially water impervious skin on at least the inner surface 38, and to have at least some surfaces devoid of skin so that cells exposed to ambient pressures. The purpose of the latter is to prevent the seal 20 from being compressed when carried to substantial water depths.

Reverting to FIG. 2, the seal 20 is disposed with the frustoconical surface 40 partially overlapping the conical edge portion 26 of the suit 10 and secured by application of waterproof, stretch resistant adhesive tape 42. The tape 42 overlies only about the lower one-third of the top bottom length of the seal.

The foam material of the seal body 30 is sufficiently soft and pliable, as well as resiliently yieldable, to permit a diver to force his head through the tapered passageway in donning, and to permit the seal to invert during head withdrawal when doffing.

A conventional, separate headgear having a hood (not shown) can be comfortably worn, and the hood makes a snug, substantially water tight seal with the outer, exposed portion of the seal 20.

Figure 4:
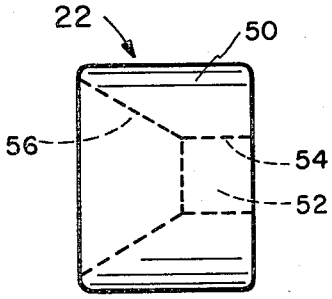
FIG. 4 is an elevational view of a wrist seal shown separately.

Referring now to FIG. 4, the wrist seals 22 are constructed similar to the neck seal 20, with appropriately changed dimension. Thus, the wrist seals each comprise a cylindrical body 50 of the neoprene rubber foam, having a tapered central, axial passage 52 defined by a cylindrical inner surface 54 and a frustoconical inner surface 56. In an actual embodiment, the seal 22 has an end to end length of 2.75 inches, an outside diameter of 4.0 inches, an inside diameter of the cylindrical surface 54 of 1.7 inches, a length of that surface of 1.0 inch, and surface 56 being at about a 30° angle to the axis. At least the inner surface 54 of the passage 52 is advantageously formed with a skin.

Figure 5:
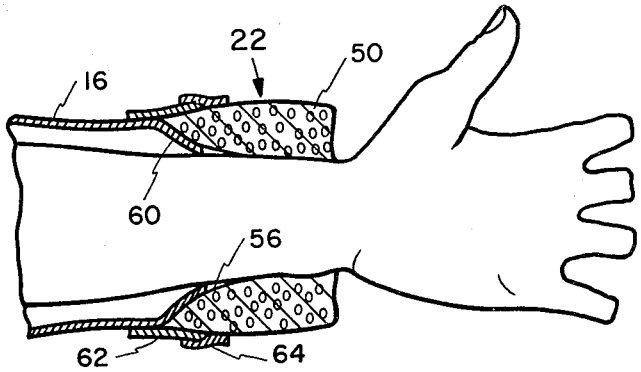
FIG. 5 is a fragmentary sectional view of a sleeve end portion of the diving suit with its wrist seal in use.

In use, the seal is secured to the outer ends of sleeves 16 as illustrated in FIG. 5. The wrist encircling opening of the sleeve 16 is defined by a conical edge portion 60 of the sleeve fabric. The seal 22 is disposed with the edge portion of the tapered surface 56 overlapping the conical edge portion 60 of the sleeve, and is secured in that position by strips 62, 64 of waterproof, stretch resistant adhesive tape. The tape covers only a small fraction of the proximal end of the seal 22.

The diver thrusts his hand through the passage 52, the seal 22 yieldably and resiliently expanding about the hand and contracting into sealing engagement with the wrist. The seal 22 operates effectively to exclude water from entering the sleeve area and, where worn, cooperates with gauntlet portions of work gloves to prevent entry of water into the glove hand.

It will be understood that the dimensions of the specific neck and wrist seals described have been given by way of example and that seals of proportionately larger or smaller sizes may be used without departing from the invention.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. In a diving suit having a body member encircling fabric edge portion defining an opening for that body member, the improvement comprising:

said fabric edge portion being conical and tapering inwardly going distally of said body member;

a seal member comprising a body of resiliently stretchable and compressible open cell foam rubber, said body having a right cylindrical outer surface, and an axial, through passage defined in part by a cylindrical inner surface and in part by a frustoconical inner surface whereby said body has an inside tapered end portion and presents a narrow annular edge at its proximal end and a broader annular edge at its distal end;

said frustoconical inner surface being partially disposed in overlapping relation to said conical fabric edge portion; and means securing said seal member to said fabric.

2. In a diving suit, the improvement defined in claim 1, and wherein:

said means securing said seal member to said fabric comprises stretch resistant adhesive tape means being applied in a band overlying said fabric and only a portion of said proximal end of said body.

3. In a diving suit, the improvement defined in claim 2, and wherein:

said body member encircling fabric edge portion comprises the neck portion of said suit, said opening comprises a neck opening, and said seal member comprises a neck seal.

4. In a diving suit, the improvement defined in claim 2, and wherein:

said body member encircling fabric edge portion comprises a sleeve of said suit, said opening comprises a wrist opening, and said seal member comprises a wrist seal.

5. In a diving suit, the improvement defined in claim 2 and wherein:

said seal member is formed with a substantially imperforate skin defining said cylindrical inner surface; and at least a portion of the remaining surfaces of said body are devoid of skin and exposed to ambient fluid, whereby said seal member is substantially unaffected by changes in ambient pressures.

6. In a diving suit, the improvement defined in claim 2, and wherein:

said frustoconical surface is disposed at an angle in the range of about 30° to about 45° relative to the central axis of said body.

7. A diving suit for use with breathing apparatus of the type including a hood adapted to cover the neck regions of the diver, said suit comprising:

a body covering of waterproof fabric including a fabric edge portion defining a neck opening, said edge portion being substantially conical and tapering inwardly going toward the diver's head;

a neck seal comprising an annular member formed of open celled, resilient foam rubber and characterized by an axial through passage that is cylindrical in the upper portion and tapered in the lower portion whereby the wall of said annular member is uniformly thick from the top end down to an intermediate location and tapers divergently from there to a relatively thin edge at the bottom end, the inside diameter of the upper portion of said member being normally something less than the diameter of a diver's neck, whereby the upper end portion of said member will resiliently close on and grip the diver's neck, the tapered portion of said annular member being complementary to and seated on said fabric edge portion; and stretch resistant tape means adhesively applied in a band overlying said relatively thin bottom edge of said annular member and said fabric so as to secure said annular member to said suit while permitting radial expansion and contraction of said upper end portion when pulled over a diver's head.

8. A diving suit as defined in claim 7, and wherein:

said through passage of said annular member is characterized by a substantially water impervious, smooth surface skin of said rubber; and other portions of said annular member being devoid of said surface skin.

9. A diving suit as defined in claim 8, and wherein:

said annular member presents a resiliently yieldably exterior cylindrical surface beyond said tape for cooperating engagement by said hood.

10. A diving suit for use with separable work gloves having gauntlet type cuffs, said suit comprising:

a body covering of waterproof fabric including sleeves having fabric edge portions defining wrist openings, said edge portions being substantially conical and tapering inwardly going distally of said sleeves;

wrist seals each comprising an annular member formed of open celled, resilient foam rubber and characterized by an axial through passage that is cylindrical in the outer end portion and tapered in the inner end portion whereby the wall of said annular member is uniformly thick from the outer end inwardly to an intermediate location and tapers divergently from there to a relatively thin edge at the inner end, the inside diameter of the outer end portion being normally something less than the diameter of the diver's wrist, whereby the outer end portion of said annular member will resiliently close on and grip the diver's wrist, the tapered portion of said annular member being complementary to and seated on one of said fabric edge portions; and stretch resistant tape means adhesively applied in a band overlying said relatively thin bottom edge of said annular member and said fabric so as to secure said annular member to said suit while permitting radial expansion and contraction of said outer end portion when pulled over a diver's hand.

11. A diving suit as defined in claim 10, and wherein:

said through passage of said annular member is characterized by a substantially water impervious, smooth surface skin of said rubber; and other portions of said annular member being devoid of said surface skin.

12. A diving suit as defined in claim 11, and wherein:

said annular members each present a resiliently yieldable exterior cylindrical surface beyond said tape for cooperating engagement by said cuffs of said gloves.

* * * * *